US005689840A

United States Patent [19]

Kuhlman

[11] Patent Number: 5,689,840

[45] Date of Patent: Nov. 25, 1997

[54] NO SPILL BEDPAN

[75] Inventor: Delmar A. Kuhlman, Wichita, Kans.

[73] Assignee: Comfort King, Inc., Wichita, Kans.

[21] Appl. No.: 606,561

[22] Filed: Feb. 26, 1996

[51] Int. Cl.[6] ..... A61G 9/00

[52] U.S. Cl. ..... 4/452; 4/450; 4/484

[58] Field of Search ..... 4/450–457, 479, 4/483, 484

[56] References Cited

U.S. PATENT DOCUMENTS

| | | | |
|---|---|---|---|
| 1,251,877 | 1/1918 | Erickson | 4/450 |
| 1,954,684 | 4/1934 | Shively | 4/450 |
| 4,062,069 | 12/1977 | Johnson | 4/450 |

OTHER PUBLICATIONS

Official Gazette Abstract of U.S. Patent No. 4,343,053, filed Jul. 11, 1980 to O'Connor.

Official Gazette Abstract of U.S. Patent No. 5,136,733, filed Mar. 20, 1989 to Church.

Contour Bedpan, published in Medline, Chapter 4 Patient Care, p. 186.

Pontoon Type Bedpan, published in Medline, Chapter 4 Patient Care, p. 186.

Stack–A–Pan Bedpan, published in Medline, Chapter 4 Patient Care, p. 186.

Autoclavable Contour Bedpan, published in Medline, Chapter 4 Patient Care, p. 188.

Autoclavable Pontoon–Type Bedpan, published in Medline, Chapter 4 Patient Care, p. 188.

Autoclavable Stackable Bedpan, published in Medline, Chapter 4 Patient Care, p. 188.

Autoclavable Fracture Bedpan and Urinal, published in Medline, Chapter 4 Patient Care, p. 188.

*Primary Examiner*—Charles E. Phillips

*Attorney, Agent, or Firm*—Shook, Hardy & Bacon L.L.P.

[57] ABSTRACT

A bedpan has a pan with an open top. The pan has back wall, a bottom surface, a pair of sidewalls and a front wall. A seat is secured to the pan. The seat has an opening in its center and a retaining wall extending downwardly from the seat and into the pan. A cover is hingedly connected to the pan. The cover has a handle and a lid and the cover has both an open and a closed position. The lid abuts the seat when the cover is in its closed position. The handle abuts the back wall of the pan when the cover is in its open position. A seal is disposed between the pan and the seat to further prevent leakage of the bedpan contents. A disposable bag is placed inside of the pan and secured to the bedpan.

10 Claims, 2 Drawing Sheets

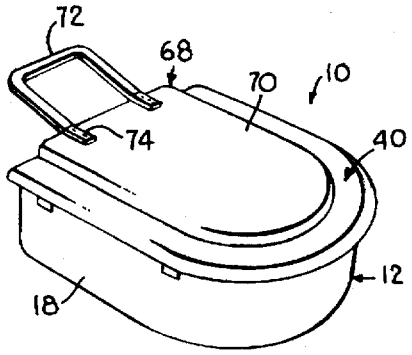
Fig. 1.
Fig. 2.
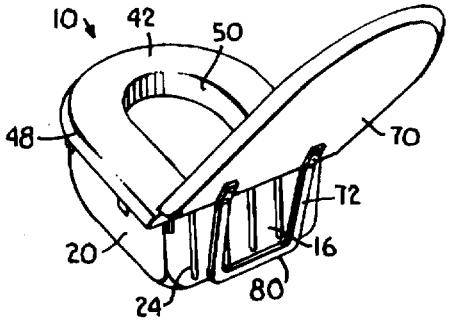
Fig. 9.
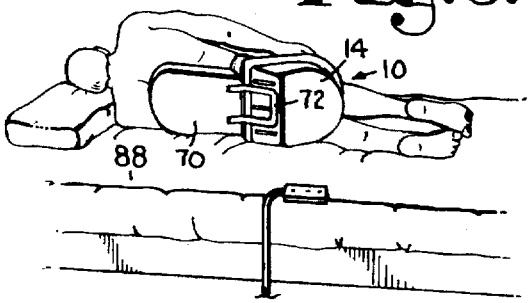
Fig. 3.
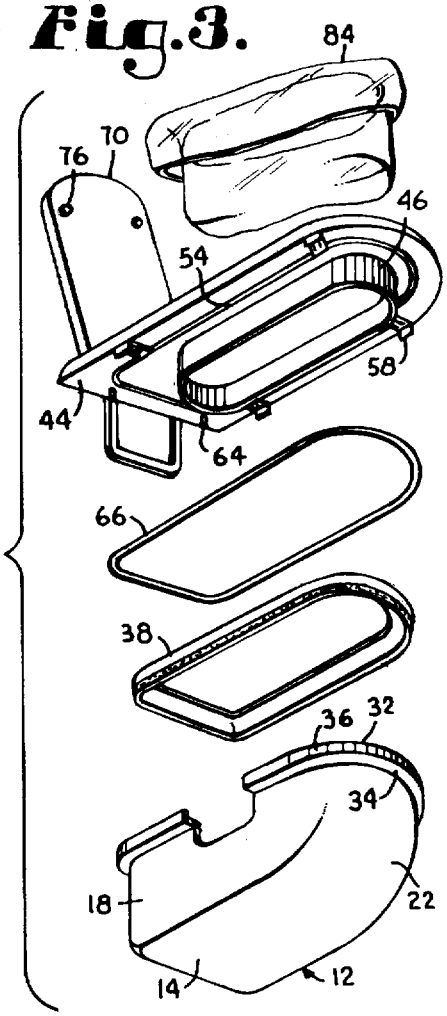
Fig. 10.
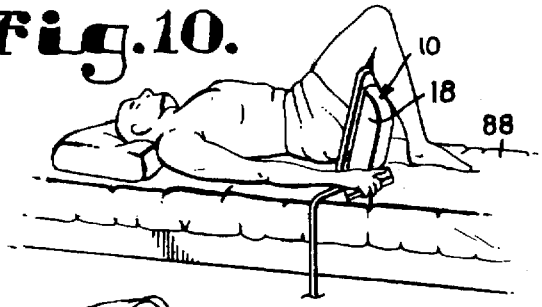
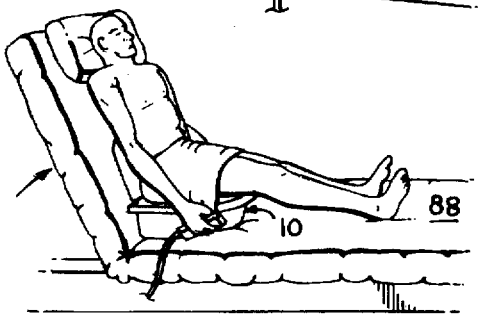
Fig. 11.

Fig.4.
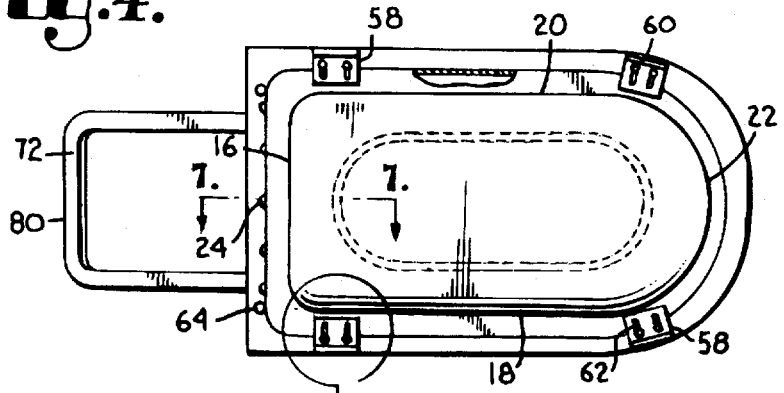
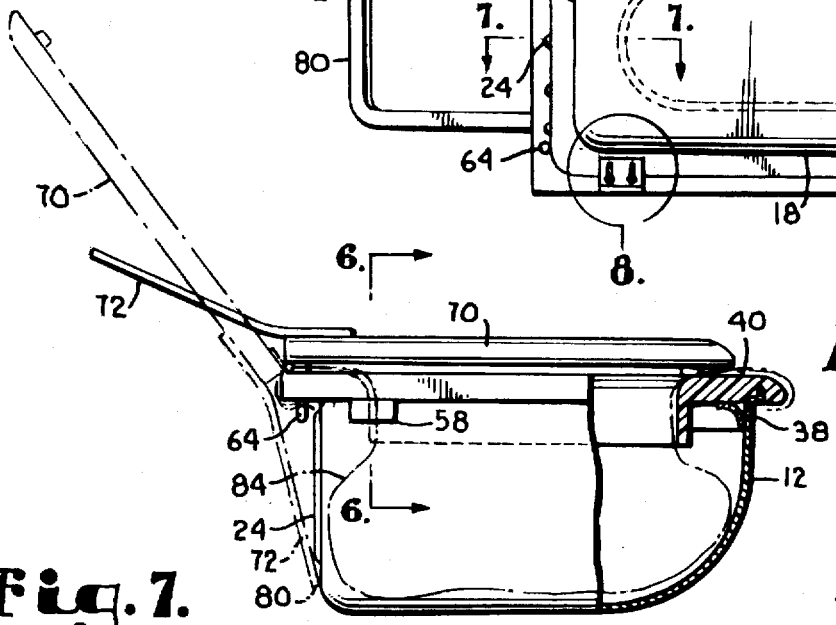
Fig.5.
Fig.7.
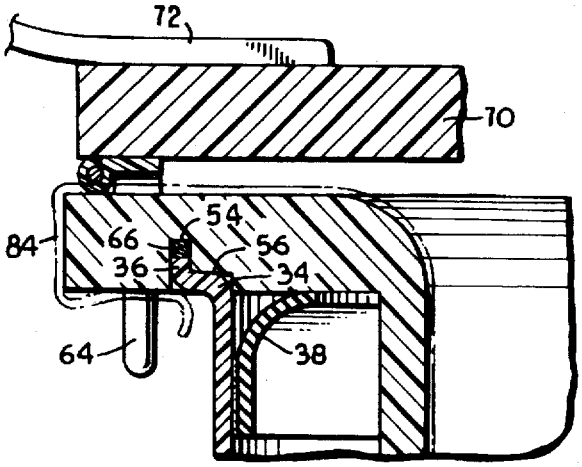
Fig.6.
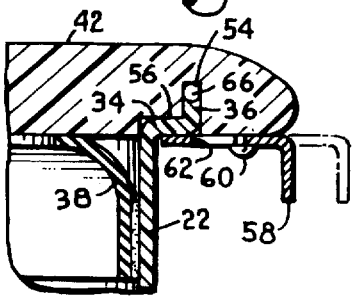
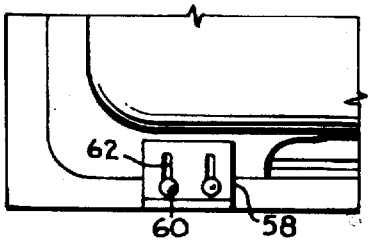
Fig.8.
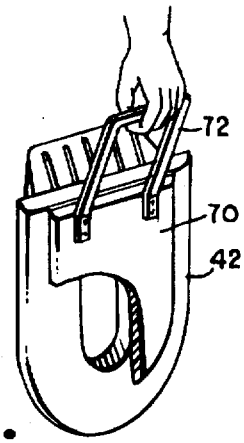
Fig.12.

NO SPILL BEDPAN

BACKGROUND OF THE INVENTION

The present invention relates to bedpans, and more particularly to bedpans for use in a hospital, institutional or home care setting.

Bedpans have been used for a great number of years for the collection of human waste. Generally, bedpans are used when the user of the bedpan is bedridden. Obviously, the bedridden user does not have the capacity to use a standard toilet. The object of the ordinary bedpan, therefore, is to allow the bedridden person access to a sanitary means for defecation and/or urination.

Bedpans typically consist of a seat, designed to comfortably rest against the user, and a collection area for the waste. In operation, the bedridden person is placed upon the seat portion of the bedpan. After the person defecates or urinates, the bedpan is removed along with the waste. The waste is then properly disposed of and the bedpan is cleaned in order to ready the bedpan for subsequent usage.

Various bedpan designs have been used throughout the history of the bedpan. The objectives of the various bedpan designs have generally been to increase the comfort of the user, as well as to increase the ease of cleaning. A further objective of the various bedpan designs has been a more efficient and easier means of positioning the bedridden person on the bedpan.

Designs focusing on this latter objective have heretofore focused on mechanical lifts or supports to position the person on the bedpan without the cumbersome and difficult task of physically lifting the person and placing the person on the bedpan. A major drawback of these designs is the resultant requirement of an additional piece of equipment in an otherwise already crowded hospital room.

A second drawback of the above designs is the continuing need to assist the person in the use of the bedpan. A hospital stay obviously results in lower expectations of privacy. However, assistance in the use of a bedpan is as an especially intrusive invasion of a person's privacy.

A further drawback of the above designs is the necessity of transporting the bedpan in a generally horizontal orientation to prevent spillage of the contents. Such a necessity limits the use and storage of the bedpan.

Thus, a bedpan is needed which will allow the user of the bedpan to use the bedpan, including the mounting thereof, without the need for assistance. Further, a bedpan is needed which can be transported and stored in a variety of positions without a spillage of the contents.

SUMMARY OF THE INVENTION

It is a primary object of the present invention to provide a bedpan so constructed to allow a person situated on an automatic hospital bed to use the bedpan without the need for assistance.

A further object of this invention is to provide a bedpan which can be mounted without assistance and which does not require any additional or special equipment beyond the invention itself.

It is yet another object of this invention to provide a bedpan which can be transported and stored in either the vertical or horizontal orientation without fear of spillage.

It is a still further object of this invention to provide a bedpan equipped with a disposable, waste-receiving bag to provide for easy cleaning.

According to the present invention, the foregoing and other objects are obtained by a bedpan that has a pan with an open top and a back wall, a bottom surface, a pair of sidewalls and a front wall. A seat is secured to the pan. The seat has an opening in its center and a retaining wall extending downwardly from the seat and into the pan. The retaining wall ensures that the contents of the bedpan remain within the bedpan even when the bedpan is in a vertical position. A cover is hingedly connected to the pan. The cover has a handle and a lid and the cover has both an open and a closed position. The lid abuts the seat when the cover is in its closed position. The handle abuts the back wall of the pan when the cover is in its open position and prevents the cover from swinging beyond the desired position.

In accordance with another aspect of the invention a seal is disposed between the pan and the seat to further prevent leakage of the bedpan contents.

In accordance with a further aspect of the invention, a disposable bag is placed inside of the pan and secured thereto.

Additional objects, advantages, and novel features of the invention will be set forth in part in the description which follows, and in part will become apparent to those skilled in the art upon examination of the following, or may be learned from practice of the invention. The objects and advantages of the invention may be realized and attained by means of the instrumentalities and combinations particularly pointed out in the appended claims.

BRIEF DESCRIPTION OF THE DRAWINGS

In the accompanying drawings which form a part of the specification and are to be read in conjunction therewith and in which like reference numerals are used to indicate like parts in the various views:

FIG. 1 is a front perspective view of a bedpan according to the present invention shown with the cover in the closed position.

FIG. 2 is a rear perspective view of the bedpan of FIG. 1 with the cover shown in the open position.

FIG. 3 is an exploded perspective view of the bedpan of FIG. 1.

FIG. 4 is a bottom plan view of the bedpan of FIG. 1.

FIG. 5 is a side elevational view of the bedpan of FIG. 1 with parts being broken away to show interior construction, the cover shown in the closed position in solid lines and shown in the open position in phantom lines.

FIG. 6 is a partial cross sectional view taken along line 6—6 in FIG. 4, with the lock shown in the closed position in solid lines and shown in the open position in phantom lines.

FIG. 7 is a partial cross sectional view taken along line 7—7 of FIG. 4.

FIG. 8 is an enlarged plan view showing the push-pull lock in a closed position and is taken from the circled region 8 in FIG. 4.

FIG. 9 –FIG. 11 are perspective views showing the bedpan of FIG. 1 in use and the sequence of mounting the invention for use.

FIG. 12 is a perspective view showing bedpan of FIG. 1 being transported in a vertical orientation.

DETAILED DESCRIPTION OF THE PREFERRED EMBODIMENTS

A bedpan embodying the principles of this invention is broadly designated in the drawings by the reference numeral 10. With initial reference to FIGS. 1 and 2, the bedpan 10 includes an open topped pan 12. Pan 12 has a bottom surface 14, a back wall 16, a pair of sidewalls designated 18 and 20, and a front wall 22. Back wall 16 and sidewalls 18 and 20 are substantially straight. Back wall 16 may be equipped with reinforcing ribs 24. Sidewall 18 is in generally parallel, mutually spaced apart relation to sidewall 20. Sidewalls 18 and 20 are in generally perpendicular relation to back wall 16. Back wall 16, sidewalls 18 and 20 and front wall 22 are each radiused inwardly at the bottom to form a smooth and continuous connection to bottom surface 14.

Pan 12 further has a lip 32 continuously extending from the top perimeter thereof. In the preferred embodiment, lip 32 is located at least four inches above bottom surface 14. Lip 32 has a horizontal ledge 34 extending outwardly from back wall 16, sidewalls 18 and 20 and front wall 22. Extending perpendicularly from ledge 34 of lip 32 is a ridge 36. Ridge 36 therefore forms the outermost perimeter of pan 12.

Attached about the interior upper portion of back wall 16, side walls 18 and 20 and front wall 22 is a sealing strip 38, as best shown in FIGS. 3 and 7. Strip 38 is preferably made of rubber or other like material, and can be attached to open topped pan 12 by an adhesive or other suitable fastening means. Strip 38 curves toward the interior of pan 12.

Attached to pan 12 is a seat 40. Seat 40 conforms substantially in shape with the outer perimeter of pan 12. Seat 40 has a top user surface 42, a bottom pan interface 44 and an generally annular retaining wall 46. User surface 42 has radiused edges 48 and 50 to enhance the comfort of the user. Retaining wall 46 is generally perpendicular to pan interface 44. Retaining wall 46 forms an opening in seat 40 through which waste can pass. Retaining wall 46 cooperates with pan 12 to prevent spillage of the bedpan contents, as is more fully discussed below. Retaining wall 46 transitions to user surface 42 via radiused edge 50. Pan interface 44 has a recessed groove 54 molded therein to accommodate ridge 36 of pan 12. Groove 54 generally encircles retaining wall 46. Pan interface 44 also has a recessed channel 56 extending adjacent groove 54. Channel 56 abuts ledge 34 of pan 12.

Seat 40 has push-pull locks 58 attached to the outer perimeter of pan interface 44 of seat 40. Locks 58 are attached to pan interface 44 by any suitable means, such as screws 60, as best shown in FIG. 8. Locks 58 are moveable inwardly and outwardly and are equipped with slots 62 for this purpose. In operation, seat 40 is placed upon pan 12 with locks 58 in the open position, extending in their outermost position, as best shown in phantom lines in FIG. 6. After ridge 36 is located within groove 54, locks 58 are moved into a closed position by pushing locks 58 inwardly, as best shown in solid lines in FIG. 6. Locks 58 actively engage the bottom of ledge 34 to prevent seat 40 from separating from pan 12. As shown in FIG. 4, four locks 58 are used in the preferred embodiment, although it should be understood that more or fewer locks could be utilized.

Protruding from pan interface 44 of seat 40 are pins 64. Pins 64 are preferably cylindrical in shape. Pins 64 are used to affix a disposable bag 84 in place. Pins 64 are located so that they will be exposed when pan 12 is engaged with seat 40. Further, pins 64 are located so that they are near the intersections of back wall 16 and sidewalls 18 and 20. Pins 64 can be molded into seat 40 or can be affixed to seat 40 with adhesive or other like material.

Disposed between seat 40 and pan 12 is an o-ring 66. O-ring 66 is shaped to conform to the shape of groove 54. O-ring 66 resides within groove 54 and operates as a seal between pan 12 and seat 40. In operation, o-ring 66 is selected so that it is slightly compressed when locks 58 are moved into a closed position. Compression of o-ring 66 operates to ensure a better seal between seat 40 and pan 12. Strip 38 operates as an additional seal between seat 40 and pan 12. When seat 40 is placed upon pan 12 and locks 58 are moved into a closed position, strip 38 is slightly compressed so that the upper edge of sealing strip 38 is in abutting relationship with pan interface 44.

Hingedly connected to seat 40 is a cover 68. Cover 68 has a lid 70 and a handle 72. Handle 72 may be molded integrally with lid 70, or may be attached to lid 70 with a suitable mechanical means of attachment, such as screws 74. The perimeter of lid 70 corresponds in shape to the outer perimeter of seat 40.

Cover 68 is swingable between a closed position and an open position. When cover 68 is in a closed position, lid 70 is generally parallel to user surface 42 of seat 40. Lid 70 abuts user surface 42 of seat 40 when cover 68 is in a closed position. Lid 70 may have rubber cushions 76 attached to the bottom thereof. In this embodiment, cushions 76 contact user surface 42 of seat 40 when cover 68 is in a closed position. Cushions 76 may be attached to lid 70 by any suitable means, such as screws or adhesives. Lid 70 therefore covers the opening defined by retaining wall 46 when cover 68 is in a closed position.

Handle 72 extends rearwardly away from back wall 16 when cover 68 is in a closed position. Handle 72 inclines from the horizontal plane when cover 68 is in the closed position. Handle 72 therefore can thus be used to retain lid 70 against seat 40 when bedpan 10 is transported in a vertical position.

When cover 68 is in an open position, lid 70 and seat 40 form an obtuse angle, as best shown in phantom lines in FIG. 5. With cover 68 in the open position, the distal end 80 of handle 72 abuts the lower portion of back wall 16. The distal end 80 of handle 72 therefore cooperates with back wall 16 to prevent lid 70 from swinging beyond the desired angle. This abutting relationship allows a user of bedpan 10 to more comfortably mount bedpan 10 without assistance, as is more fully described below.

Handle 72 has a generally rectangular shape. Handle 72 has an opening disposed in the center thereof for grasping and transporting bedpan 10 when bedpan 10 is not in use. This opening can further be used to hang bedpan 10 alongside the bed of a user.

Disposable bag 84 can be used to aid in cleaning bedpan 10. In this embodiment, the body of bag 84 is disposed through the opening defined by retaining wall 46 and within the interior of pan 12. Bag 84 is generally secured to bedpan 10 around the perimeter of seat 40, as best shown in phantom lines in FIG. 5. Pins 64 are used to pierce bag 84, thereby securing bag 84 in place. After use, bag 84 may simply be removed from bedpan 10 and discarded. Bedpan 10 is again ready for use upon installation of a new bag 84.

In operation, with reference to FIGS. 9 – 11, the bedpan of the current invention can be used by a bedridden patient without the need of assistance. In a normal hospital stay, the patient will be situated upon an automatic hospital bed 88. The head of bed 88 can be raised or lowered by the patient by simply pressing the appropriate button. The importance of bed 88 to the use of bedpan 10 is described more fully below.

When the patient desires to use bedpan 10, the patient simply removes bedpan 10 from its storage position alongside bed 88, and swings cover 68 to the open position. The patient then positions himself or herself on his or her side. Cover 68 of bedpan 10 is then placed in the open position, with distal end 80 of handle 72 in abutting relationship with back wall 16. Bedpan 10 is then positioned on its side. Next bedpan 10 is positioned so that top user surface 42 is positioned substantially against the patient's buttocks, with lid 70 against the patient's back, as best shown in FIG. 9. The patient then rolls over so that the lid 70 is positioned between the surface of bed 88 and the patient's back, as shown in FIG. 10. In this position, lid 70 is held in place by the weight of the patient. Handle 72 remains in abutting relationship with back wall 16. The relationship of lid 70, handle 72 and pan 12 can thus be seen to maintain pan 12 in the desired orientation throughout the mounting procedure. The patient then elevates the head of bed 88 by pressing the appropriate button. When the head of bed 88 is elevated to the desired position, the patient will be properly positioned on bedpan 10, and more specifically on seat 40, as shown in FIG. 11. The obtuse angle formed between lid 70 and seat 40 conforms to the elevation angle of bed 88. Thus, pan 12 is maintained in the desired position on bed 88 through the relationship of handle 72 and back wall 16. Further, the patient remains properly positioned on bedpan 10, with the patient's back resting against lid 70 and the head of bed 88.

When desired, the patient can dismount bedpan 10 by reversing the above procedures. The head of bed 88 can be lowered by pressing the appropriate button. When bed 88 is returned to a generally horizontal position, the patient can roll to the side. The patient can then swing cover 68 into a closed position, and return bedpan 10 to its storage position alongside the bed. The contents of bedpan 10 will be retained within pan 12 by retaining wall 46. Bedpan 10 can then be transported in a vertical position to a disposal and cleaning site. Handle 72 operates to maintain lid 70 against seat 40. Alternatively, the patient can remove bag 84 from bedpan 10, securely close bag 84, and place bag 84 in a suitable holding container (not shown) adjacent bed 88. Bedpan 10 can then be returned to its storage position alongside bed 88.

Having thus described the invention, what is claimed is:

1. A bedpan comprising:

an open topped pan having a back wall, a bottom surface, a pair of sidewalls and a front wall, said pan also having a seat secured thereto, said seat having an opening disposed in the center thereof and a retaining wall extending downwardly from said seat and into said pan; and a cover having a lid and a handle, wherein said handle extends rearwardly away from said back wall, said cover being hingedly secured to said pan so that said lid is swingable between a closed position wherein said lid is generally parallel to said seat and an open position wherein said lid forms an obtuse angle with said seat; and wherein said lid abuts said seat when said lid is in its closed position; and wherein a distal end of said handle abuts said back wall when said lid is in the open position so that said lid is prevented from further rearward swingable movement.

2. The bedpan of claim 1 wherein said handle inclines from the horizontal plane of said lid when said lid is in its closed position so that said lid is maintained in abutting relationship with said seat when the bedpan is transported in a generally vertical position.

3. The bedpan of claim 1 wherein said seat is secured to said pan by a series of locks connected to said seat.

4. The bedpan of claim 3 further comprising a sealing gasket disposed between said seat and said pan, wherein said gasket forms a seal between said seat and said pan when said locks are engaged.

5. The bedpan of claim 1 further comprising a sealing strip attached to the interior of said pan, wherein said sealing strip forms a seal between said seat and said pan.

6. The bedpan of claim 1 wherein said back wall is reinforced.

7. The bedpan of claim 1 further comprising a disposable bag wherein the body of said bag is disposed inside of said pan and wherein said bag is secured to the bedpan generally around the outer perimeter of said seat.

8. The bedpan of claim 7 wherein pins are disposed on the bottom of said seat, and wherein said pins are used to secure said disposable bag in place.

9. The bedpan of claim 1 wherein said front wall, said sidewalls and said back wall of said pan are at least 4 inches high.

10. A bedpan comprising:

an open topped pan having a back wall, a bottom surface, a pair of sidewalls and a front wall, said pan also having a seat secured thereto, said seat having an opening disposed in the center thereof and a retaining wall extending downwardly from said seat and into said pan; and a cover having a lid and a handle wherein said handle extends rearwardly away from said back wall; and wherein said handle inclines from the horizontal plane of said lid when said lid is generally parallel to said seat with said pan resting on said bottom surface and when said bedpan is being transported by use of said handle, with said pan in a generally vertical position said lid is maintained in abutting relationship with said seat which together with said retaining wall will maintain the contents of the bedpan within said pan.

* * * * *